United States Patent [19]

Grunewald et al.

[11] Patent Number: 4,462,299

[45] Date of Patent: Jul. 31, 1984

[54] MECHANISM THAT AUTOMATICALLY OPENS THE BREECH BLOCK WEDGE ON A SEMI-AUTOMATIC WEAPON

[75] Inventors: Peter Grunewald, Fuldabruck; Rudolf Brockmeyer, Vellmar, both of Fed. Rep. of Germany

[73] Assignee: Firma Wegmann & Co. GmbH, Kassel, Fed. Rep. of Germany

[21] Appl. No.: 436,500

[22] Filed: Oct. 25, 1982

[30] Foreign Application Priority Data

Oct. 27, 1981 [DE] Fed. Rep. of Germany ..... 3142457

[51] Int. Cl.[3] ..... F41F 11/02

[52] U.S. Cl. ..... 89/24; 89/9; 89/29

[58] Field of Search ..... 42/5; 89/9, 24, 28 R, 89/29, 135

[56] References Cited

U.S. PATENT DOCUMENTS 3,537,353 11/1970 Nelson ..... 89/135

*Primary Examiner*—Stephen C. Bentley

*Attorney, Agent, or Firm*—Sprung, Horn, Kramer & Woods

[57] ABSTRACT

A mechanism that automatically opens the breech block wedge on a semi-automatic weapon, especially a tank cannon with a training liner. Mounted on the breech of the weapon is an electromechanical drive mechanism that includes an electric motor with a drive shaft on which is mounted an energy-saving flywheel that can be connected through adjustable couplings and a reduction gear to an opener shaft on which is mounted an opener lever that shifts the breech block wedge into the open position when the shaft rotates. The flywheel is accelerated to a nominal speed when the couplings are disengaged. Electronic controls then engage the couplings for a predetermined amount of time and turn off the electric motor. Some of the energy of rotation of the flywheel is transferred to the opener lever. The couplings are then disengaged and the electric motor turned on again. The electronic controls are practically activated by the firing pulse and/or the actual firing procedure.

11 Claims, 2 Drawing Figures

MECHANISM THAT AUTOMATICALLY OPENS THE BREECH BLOCK WEDGE ON A SEMI-AUTOMATIC WEAPON

BACKGROUND OF THE INVENTION

The present invention relates to a mechanism that automatically opens the breech block wedge on a semi-automatic weapon, especially a tank cannon with a training liner.

When tank cannons are fired for practice and training, they are often equipped with training liners to make it possible to employ smaller-caliber and hence more cost-effective ammunition.

This ammunition, with calibers of up to 35 mm, does not, however, create enough recoil for the breech block wedge to open automatically to receive the next round. The loader must open the wedge by hand after every round by rotating the opener shaft with a manual lever. This is very difficult and takes a relatively long time, especially in the field. It is not even approximately comparable in time and function to loading and firing with ammunition of the caliber (120 mm, for example) that is conventional for this weapon, wherein breech will open automatically as a result of recoil, allowing a firing rate of up to 8 rounds a minute.

To meet such a requirement with some degree of approximation, it is necessary for the breech block wedge to open automatically, independently of the loader, and in a specific sequence when a training liner is employed with small-caliber ammunition.

It is impossible to simulate recoil in order to trigger normal automatic breech block-wedge opening without considerable engineering expense because of the power that would be required.

SUMMARY OF THE INVENTION

The object of the present invention is to provide a mechanism, of the type initially described, that will open the breech block wedge automatically and that will permit the weapon to be loaded during practice and training under realistic conditions and with low engineering expense when a training liner is employed. The mechanism is designed to be mounted on the weapon without taking up interior space and will require little power, especially when used on a tank, which has a limited amount of power available in its electric system.

The invention achieves its objective with a breech block wedge which is connected to an electromechanical drive mechanism that includes an electric motor with a drive shaft that is rigidly connected to an energy-saving flywheel that is in turn connected through at least one adjustable coupling to the drive shaft of a mechanical opener.

Positioning an energy-saving flywheel between the electric motor, the drive mechanism, and the mechanical opener provides enough output to open the breech block wedge without putting too much of a load on the vehicle's electric system. The invention stores the energy required to open the breech block wedge for a certain amount of time (8 seconds, for example) and then ransmits it during a shorter amount of time (0.3 seconds, for example) to the mechanical opener.

The invention consists of relatively few parts that are easy to mount on the weapon.

Practical embodiments of the invention are described in the subsidiary claims.

The mechanical opener may, for example, be a simple mechanical opening layer. It is practical to position a reducing gear between the flywheel and the opener drive shaft. The adjustable coupling can be electromagnetic and controlled by electronic controls. These controls can be designed to turn on the electric motor when the coupling is open. Once the flywheel attains a predetermined number of revolutions per minute the motor turns off again and a control signal is simultaneously or subsequently emitted to activate the coupling for a predetermined amount of time, during which the flywheel will be coupled to the opener drive shaft. It is also practical to release the coupling just before the breech block wedge arrives at its end position. This prevents the flywheel from coming to a complete stop, so that it will retain a certain amount of its energy of rotation and relieve the motor in its subsequent acceleration to nominal speed.

It is practical for safety's sake to govern the controls with a special signal that will initiate wedge opening only when a round is actually going to be fired. This control signal can be derived either from a firing pulse emitted by the electric firing system or from the actual firing procedure. Both of these methods can, however, also be employed to initiate opening. A signal derived from the actual firing procedure can be generated from a recoil-activated limit switch. It can also be generated by a piezoelectric acceleration generator mounted on the weapon and responding for example to the structural reverberation generated when the weapon is fired.

The invention can be mounted by the gun crew without significant engineering expense and without altering the design of the weapon in any way.

One embodiment of the invention will now be specified with reference to the drawings, in which:

DETAILED DESCRIPTION OF THE INVENTION

Figure 1:
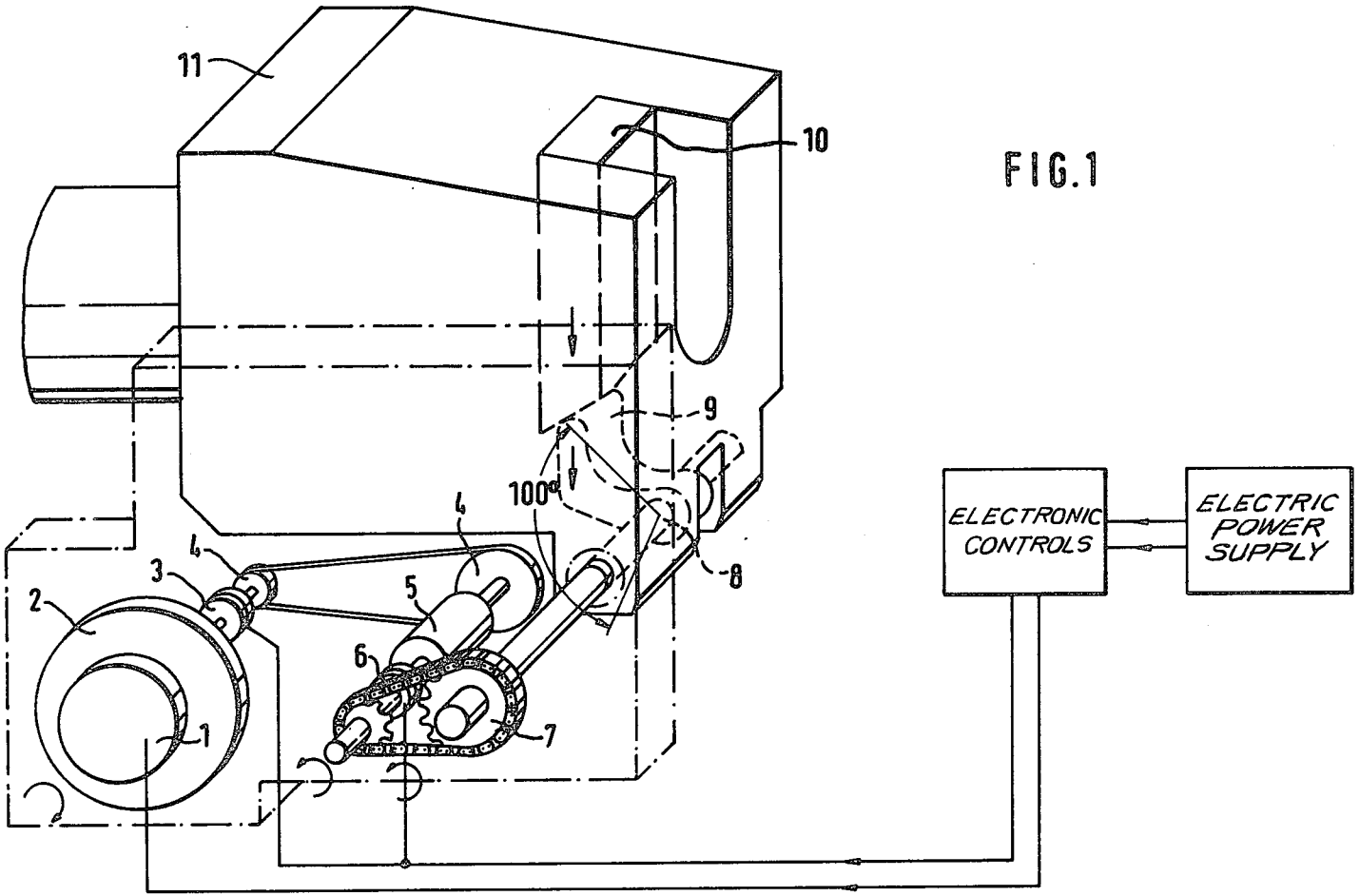
FIG. 1 is a schematic parallel-perspective drawing of a mechanism in accordance with the invention that is mounted on the breech block of a weapon and opens the breech block wedge.

Referring to FIG. 1, an electromechanical drive mechanism is mounted on the breech block 11 of the weapon and includes an electric motor 1 that has a flywheel 2 on its drive shaft and that is connected through an electromagnetic friction coupling 3, a belt drive 4, a reversible reduction gear 5, an electromagnetic denture clutch 6, and a chain drive 7 to an opener lever 9. The opener shaft 8 rotates about 100°. When opener shaft 8 rotates, opener lever 9 shafts breech block wedge 10 in the direction indicated by the arrows into its opening position.

Figure 2:
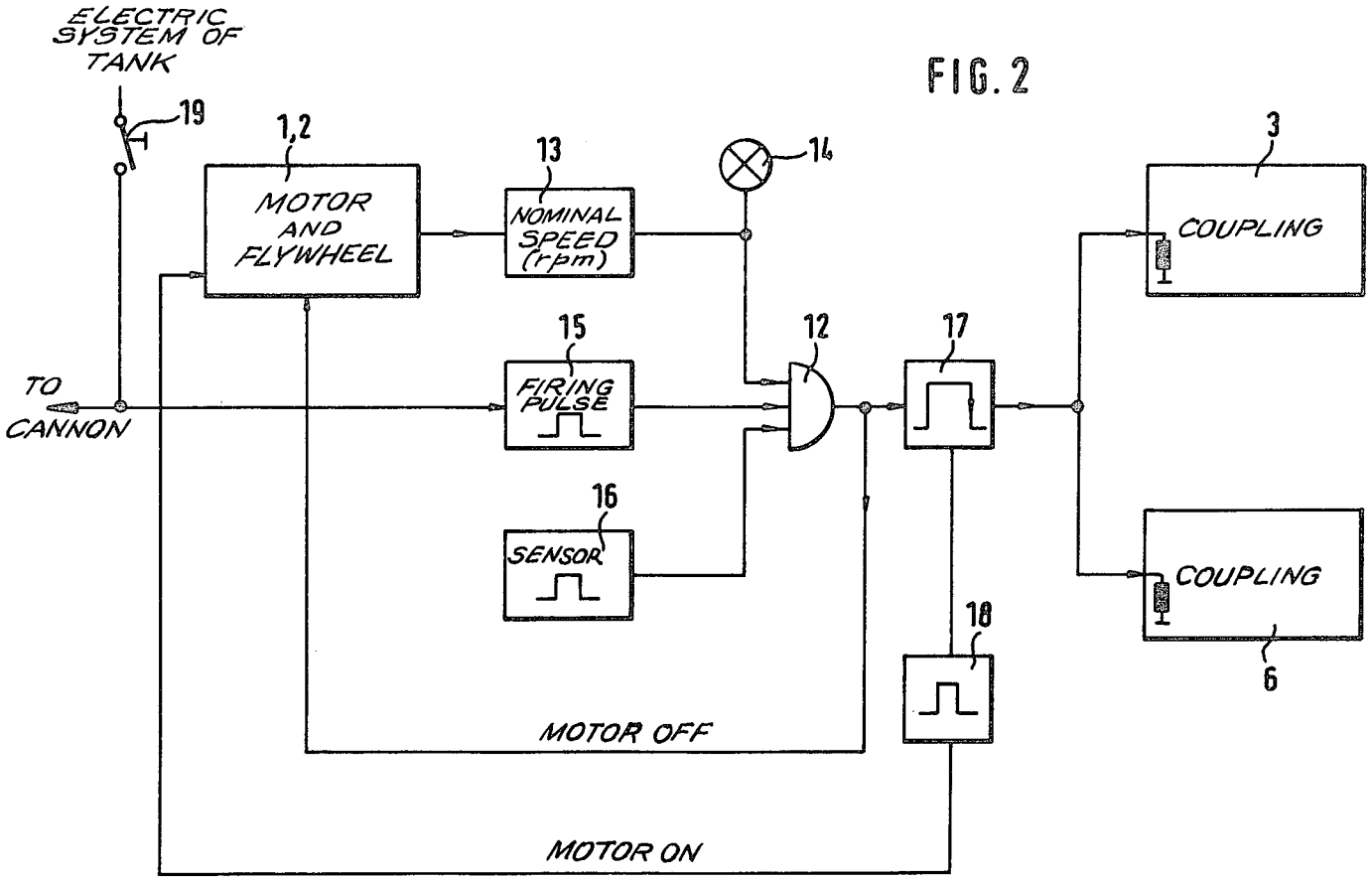
FIG. 2 is a block diagram of electronic controls that can be employed with a device like the one illustrated in FIG. 1.

Electric motor 1 and the two electromagnetic couplings 3 and 6, which may be of a commercially available type, are governed by the control device called electronic controls in FIG. 1 and illustrated in detail in FIG. 2. These controls have a three-input AND gate 12. A specific signal is supplied to each of the inputs of AND gate 12.

One signal is derived from a device 13 and indicates that the flywheel 2 has reached its "nominal" speed. Device 13 can be a commercially available tachometer generator, for example, and can be connected to flywheel 2 in a way that is not specifically illustrated in FIG. 1. A signal lamp 14 also indicates that nominal speed has been reached.

Another signal is derived from a pulse generator 15 and indicates the presence of a firing pulse. Pulse generator 15 is controlled by an electric firing signal generated by a pushbutton switch 19 that is connected to the conventional electric system of a tank in a way that is not specifically illustrated. The signal derived from pushbutton switch 19 is supplied on the one hand to pulse generator 15 and on the other hand, over the line labeled "to cannon." to the firing mechanism.

A third signal is derived from a device 16 labeled "sensor" and indicates whether firing is actually going on. Device 16 contains an ordinary pulse generator controlled by a sensor that detects an actual firing procedure. The sensor can for example be an ordinary limiting switch that is mounted on breech block 11 in a way that is not specifically illustrated and that is activated by the recoil. A piezoelectric acceleration generator of known design can, however, also be employed, mounted in a way that is not specifically illustrated at an appropriate point on the weapon and responding for example to the structural reverberation generated when the weapon is fired.

When all three of these signals are at AND gate 12, it releases a control signal to a pulse generator 17, which in turn releases a control signal that governs electromagnetic couplings 3 and 6. Electric motor 1 is simultaneously turned off. The falling edge of the signal derived from pulse generator 17 activates another generator 18, which releases an output signal that turns electric motor 1 on again.

The function of the mechanism specified with reference to FIGS. 1 and 2 will now be described.

Electric motor 1, which is connected to the electric system of the tank, for example, is turned on and accelerates flywheel 2 to the requisite nominal speed. Electromagnetic couplings 3 and 6 are not engaged. Breechblock wedge 10 is opened at first by the loader with a manual lever through opener shaft 8. The weapon is loaded. Breechblock wedge 10 is closed automatically with a closure mechanism integrated into the weapon but not specifically illustrated. The weapon is fired. As soon as the signal indicating the presence of a firing pulse, the signal indicating the occurrence of the firing procedure, and the signal indicating that nominal speed has been reached arrive at AND gate 12, the electronic controls emit a control signal to electromagnetic couplings 3 and 6, which are simultaneously engaged after a predetermined amount of time or a predetermined distance traveled by breech block 20, coupling flywheel 2 to opener shaft 8. The high speed of electric motor 1 is converted by reduction gear 4, 5, and 7 into a slow rotation of about 100°. Just before opener shaft 8 or breech block wedge 20 arrives at its end position, electromagnetic couplings 3 and 6 separate again and pulse generator 18 simultaneously turns off electric motor 1. Motor 1 restores flywheel 2, which has not yet come to a complete stop, to nominal speed. The weapon is reloaded, the breech block wedge closes automatically, and the weapon is fired.

It will be appreciated that the instant specification and claims are set forth by way of illustration and not limitation, and that various modifications and changes may be made without departing from the spirit and scope of the present invention.

We claim:

1. In a semi-automatic weapon receptive of a preselected caliber ammunition and having a breech and a breech block wedge which opens upon recoil by the preselected caliber ammunition, the improvement comprising a mechanism for automatically opening the breech block wedge when a training liner and less than said preselected caliber ammunition is used in the weapon, the mechanism comprising an electromechanical drive mechanism connected to the breech block wedge and including one mechanical opening means engaging the breech block wedge and having a drive shaft for actuating same, an electric motor with a drive shaft that is rigidly connected to an energy-saving flywheel and at least one adjustable coupling between the flywheel and the drive shaft of the mechanical opening means.

2. The mechanism as in claim 1, wherein the opening means comprises an opening lever mounted on a drive shaft for rotatable movement therewith about a predetermined angle to shift the breech block wedge into the open position when the drive shaft rotates.

3. The mechanism as in claim 1, further comprising a reduction gear between the flywheel and the drive shaft of the opening means.

4. The mechanism as in claim 3, wherein the one adjustable coupling is disposed between the flywheel and the reduction gear.

5. The mechanism as in claim 4, further comprising another adjustable coupling between the reduction gear and the drive shaft of the opening means.

6. The mechanism as in claim 5, wherein the couplings are electromagnetic.

7. The mechanism as in claim 5, further comprising electronic control means for turning on the electric motor when said one coupling is open, turning it off when the flywheel reaches a predetermined speed, and simultaneously with or subsequently to turning off the motor, producing a control signal that activates said one or both couplings for a predetermined length of time.

8. The mechanism as in claim 7, further comprising means for generating an output signal in response to at least one of the electrical firing pulse and the actual firing procedure and applying same to the electronic control means for producing said control signal.

9. The mechanism as in claim 8, wherein the output signal generating means comprises a three-way AND gate that has inputs to which are supplied a signal indicating that the flywheel has reached its nominal speed, a signal derived from the firing pulse, and a signal derived from the actual firing process and that emits the output signal wherein the control means includes a device receptive of the output signal for turning off the electrical motor, a first pulse generator receptive of the output signal for emitting a first pulse of a predetermined length, which is supplied to the control inputs of the couplings and, a second pulse generator that is triggered by the falling edge of the first pulse to produce a second pulse that turns on the electric motor.

10. The mechanism as in claim 8, wherein the signal derived from the actual firing procedure is generated by a limiting switch activated by the recoil of the weapon.

11. The mechanism as in claim 8, wherein the signal derived from the actual firing procedure is generated by the piezoelectric acceleration generator mounted on the weapon.

* * * * *